US005802790A

United States Patent [19]

Lamont et al.

[11] Patent Number: 5,802,790

[45] Date of Patent: Sep. 8, 1998

[54] DECORATIVE MOULDING CORNER CAP

[75] Inventors: Bernard Lamont, Gatineau; David Rozon, Russell, both of Canada

[73] Assignee: 3429342 Canada Ltée, Hull, Canada

[21] Appl. No.: 699,440

[22] Filed: Aug. 19, 1996

Related U.S. Application Data

[60] Provisional application No. 60/011,918, Feb. 20, 1996.

[51] Int. Cl.[6] ..... E04B 1/00

[52] U.S. Cl. ..... 52/288.1; 52/287.1; 52/272

[58] Field of Search ..... 52/287.1, 288.1, 52/272; 160/19, 38, 39

[56] References Cited

U.S. PATENT DOCUMENTS

| | | | |
|---|---|---|---|
| 3,201,910 | 8/1965 | Keesee | 52/287.1 |
| 3,616,587 | 11/1971 | Schlafly, Jr. | 52/287.1 |
| 3,956,861 | 5/1976 | Rasmussen | 52/287 |
| 4,315,390 | 2/1982 | Schaafsma | 52/287.1 |
| 5,001,877 | 3/1991 | Edwards | 52/288 |
| 5,199,237 | 4/1993 | Juntunen | 52/288 |
| 5,315,799 | 5/1994 | Cullinan | 52/287.1 X |
| 5,359,817 | 11/1994 | Fulton | 52/288.1 |
| 5,398,469 | 3/1995 | Logan | 52/272 X |
| 5,457,923 | 10/1995 | Logan et al. | 52/272 X |
| 5,555,687 | 9/1996 | Logan et al. | 52/272 X |
| 5,592,797 | 1/1997 | Logan et al. | 52/272 X |

FOREIGN PATENT DOCUMENTS

| | | | |
|---|---|---|---|
| 899589 | 5/1972 | Canada | 20/94 |
| 1182975 | 2/1985 | Canada | 20/96 |

*Primary Examiner*—Beth A. Aubrey
*Attorney, Agent, or Firm*—Adrian Zahl

[57] ABSTRACT

The invention consists of an assembly for capping one or more exposed ends of a moulding, in particular where two elongate moulding pieces meet at a corner. The assembly consists of upper and lower rims and a web portion extending between the rims. The rims each incorporate snap-lock engagement members to releasably engage an underlying linear moulding in a sliding-type engagement. The engagement members each consist of a curved elongate flange extending from the rim, having a generally hook-shaped cross section adapted to mate with a corresponding rib extending from a linear moulding. The assembly may consist of two generally platelike separable portions that mate at the midline of the assembly to form a generally L-shaped member for installation at a room corner. The invention also consist of a combination of the corner assembly and a linear moulding having sliding engagement members adapted to mate with corresponding engagement members within the corner member.

11 Claims, 3 Drawing Sheets

DECORATIVE MOULDING CORNER CAP

This application was disclosed in United States Provisional Application No. 06/011,918, filed Feb. 20, 1996.

FIELD OF THE INVENTION

The invention relates to a decorative moulding element for interior residential or building use, and in particular to an assembly adapted to cover exposed ends of linear mouldings, either at a room corner or partway along a wall or the like. The cover may be adapted to form a corner member for use in a moulding or trim installation, such as crown or baseplate mouldings, or may be adapted to serve as a corner cap in a valance assembly, or to cover an intersection of two co-linear elongate moulding members.

BACKGROUND OF THE INVENTION

The fitting and installation of trim and moulding at inside and outside corners of a room typically represents a time-consuming and difficult task, particularly for homeowners. The job is made easier with the use of precut corner members that are adapted to mate with elongate linear mouldings, thus saving the mitering step. In order to avoid the requirement of trimming the linear members to a precise length to abut the corner member, the corner member may comprise a caplike structure that mates with and covers the exposed ends of linear members. Since the ends of the linear mouldings are thus hidden from view, it is not required to trim them to a precise length. This type of capping element may be adapted to extend around an inside or outside corner, or to join two co-linear elongate members.

For example, U.S. Pat. No. 5,199,237 (Juntunen) discloses a cap that covers the exposed ends of moulding at either a corner or at the intersection of two co-linear lengths of moulding. The cap is glued to the moulding at an appropriate position. Similar arrangements are disclosed in U.S. Pat. Nos. 5,001,877 (Edwards) and 3,956,861 (Rasmussen) and Canadian Patent 1,182,975 (Heuser).

These existing corner members suffer the disadvantage that their installation is still relatively time-consuming, since they must be glued or otherwise fixedly engaged into position. As well, since they are pre-formed for a mass market, they are not well suited for use with corners that are less or greater than right angles.

Existing types of pre-cut corner or capping assemblies are not particularly well-suited for use with decorative linear mouldings and valances of the type disclosed in the present inventors' related application Ser. Nos. 60/011,918 and 08/643,876. This type of linear moulding is fabricated typically from extruded plastic and has as its front face a replaceable decorative slat-like panel. The moulding is shaped to provide a forward-facing channel to retain the slat. The slat may be retained in either a planar configuration or a convex or concave configuration, relative to the moulding. Typically, the user of this type of moulding replaces the slat to coordinate the moulding with window blinds or other decor elements in the room. This type of moulding may be adapted for use as baseplate, cornice or chair rail moulding, or as a decorative box-type valance to cover the headrail of a window blind, curtain or the like. For this latter application, the side and front panels of the valance are comprised of mouldings, joined at their intersections by a corner assembly, to form a three-sided boxlike structure. A corner assembly should present the appearance of a gap-free junction where it meets the linear moulding. As well, the assembly must be capable of permitting the user to readily install the moulding system and replace a decorative slat retained within the linear moulding.

These objectives may be achieved by the use of a cap-like corner assembly that may be engaged to the outer face of a linear moulding element by means of a snap-lock, slideable engagement means, and which can overlap and cover an exposed end of the linear member. The slideable engagement permits the assembly to be slid into its final position along the linear moulding.

A corner assembly may comprise either a generally L-shaped member adapted to fit around two sides of a corner, or a generally platelike rectangular member adapted to be installed at one side of a corner or the like where it is desired to terminate the moulding at the corner. The assembly may also comprise a platelike capping member for installation partway along a wall to cover the junction between two adjacent co-linear elongate members. It will be apparent that other installations are possible. The term "corner member" will be used herein to refer both to moulding members that are adapted specifically for use in corner installations and as well to members that may be used to cover the free ends of linear mouldings at positions other than at corners. The term includes both L-shaped and planar members.

SUMMARY OF THE INVENTION

In light of the objects recited above, this invention comprises a linear moulding capping assembly comprising a member defined by upper and lower rims and a web portion extending between the rims. The assembly is shaped to fit over the exposed outer surface of a linear moulding in such a manner as to overlap and cover the exposed free end of the linear moulding from sight. At least one end of the corner member is generally squared-off, and when the corner member is fitted over the linear moulding it presents the appearance of a precise and gap-free abutment. The upper and lower rims of the assembly each incorporate snap-lock engagement means to releasably engage an underlying linear moulding in a sliding-type engagement. The sliding engagement permits the corner assembly to be precisely fitted into a corner after engagement of the assembly to the moulding. As well, the sliding engagement facilitates replacement of a decorative panel retained within a moulding. The engagement means each comprise a curved elongate flange extending from the rim, having a generally hook-shaped cross section, adapted to mate with a corresponding rib extending from a linear moulding.

The web portion of the assembly may be shaped to accommodate either a planar, convex or concave front face of a linear moulding, and preferably provides sufficient space to permit easily removal of a replaceable front panel retained within the linear moulding, without disassembly of the moulding from the corner assembly.

In a preferred version, the assembly comprises two generally platelike separable portions that mate to form a generally L-shaped member. Each portion may be engaged to a corresponding linear moulding, and slid into position to meet at the corner. This arrangement is particularly well suited for installations where the corner does not comprise a right angle.

The assembly may comprise either an L-shaped member adapted to extend around an inside or outside corner, or a generally planar member adapted to cap the junction of two co-linear moulding members.

The invention further comprises a combination of the corner assembly and a linear moulding having sliding engagement means adapted to mate with corresponding engagement means within the corner member.

The corner assembly may be adapted for use with baseplate, cornice or chair rail mouldings. As well, it may be adapted for use with valances that comprise planar moulding-type members arrangement in a three-sided box-like configuration, with the corner assemblies being installed at the outside corners of the valance.

DETAILED DESCRIPTION OF THE PREFERRED EMBODIMENT

Figure 1:
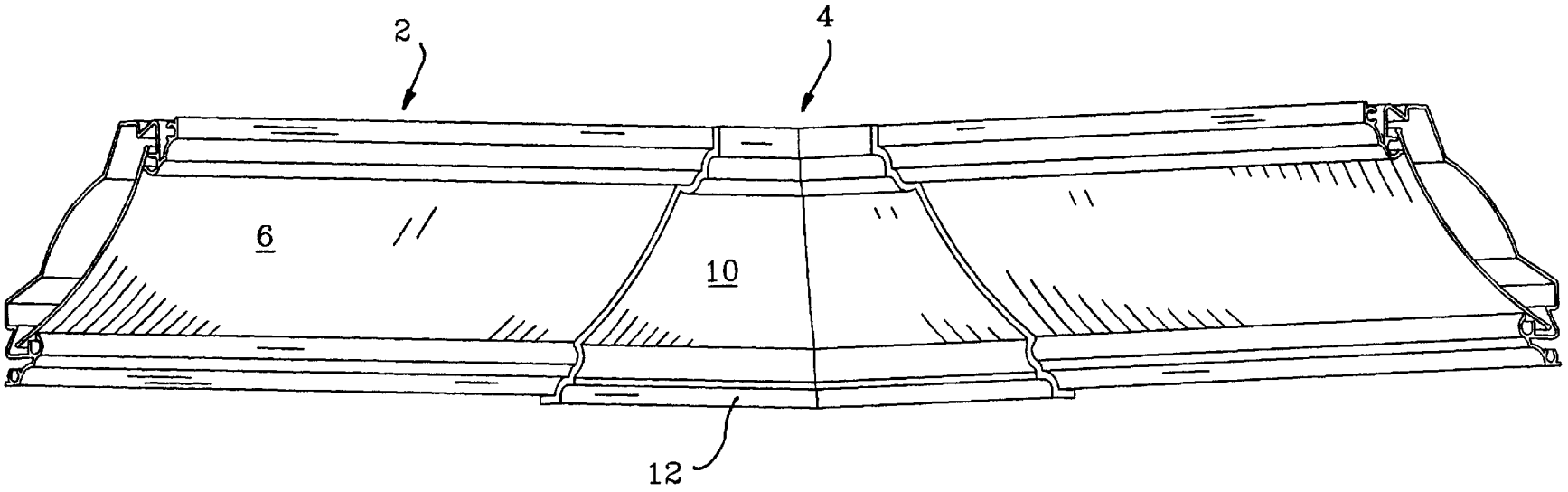
FIG. 1 is a perspective view of the present invention, installed on a pair of linear cornice moulding members at an inside corner of a room.
Figure 2:
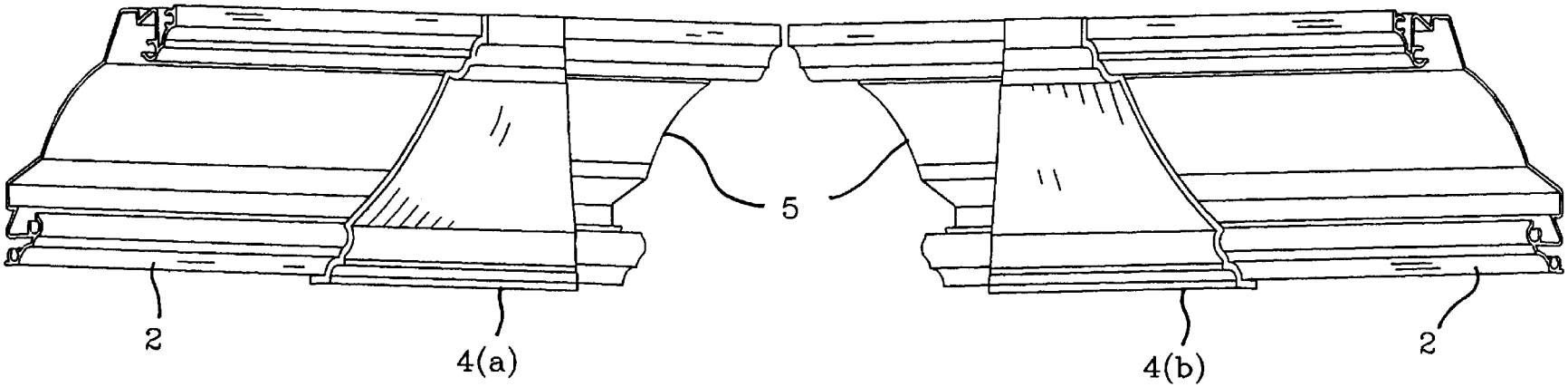
FIG. 2 is a perspective view as in FIG. 1, before installation.
Figure 3:
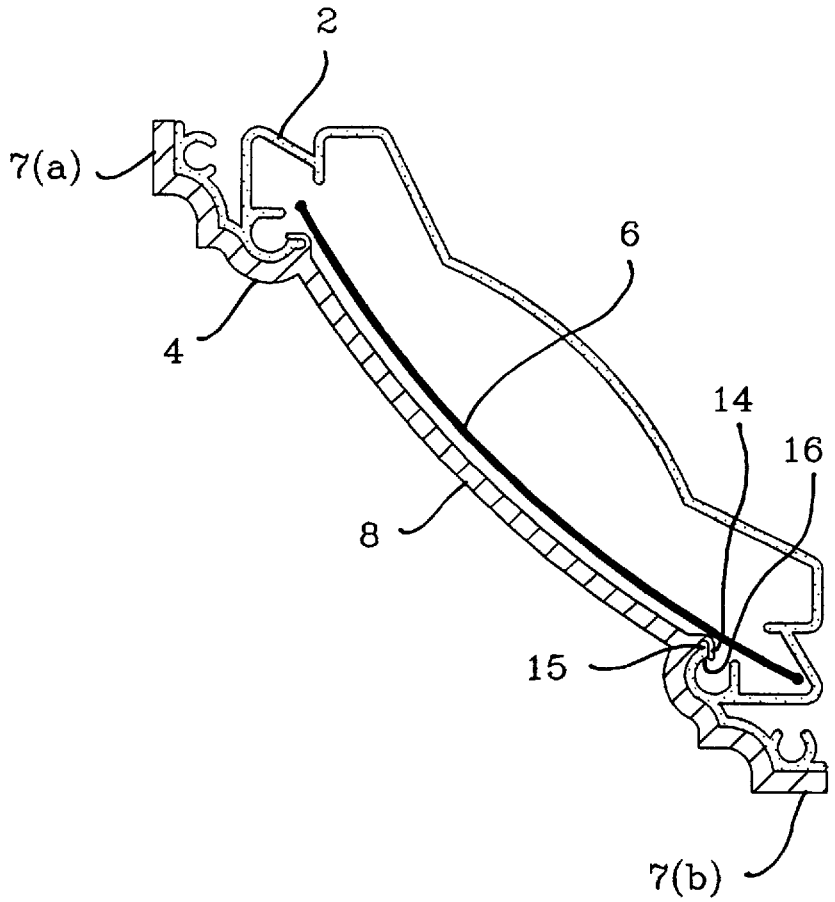
FIG. 3 is a sectional view of the invention, installed on a linear cornice moulding element.

The present invention is illustrated in FIGS. 1–3. It will be understood that the term "linear moulding" refers to a generally straight (or in some cases curved) moulding of the type that is typically installed along the intersection between a wall and floor or ceiling, or where two walls meet. A "corner assembly" is a moulding element according to the present invention that comprises a cap or cover to fit over an exposed end of a linear element. A corner assembly according to the present invention may be adapted to serve various installation options. In one use, it may be installed at an inside or outside corner, i.e., a concave or convex corner of a room where abutting linear elements join. For this use, the assembly is generally L-shaped when seen in plan. In another application, the corner assembly may be installed at a corner where the linear moulding terminates. For this application, since the corner assembly terminates at the corner rather than extending around the corner, it consists of a generally rectangular platelike member. A corner assembly with a similar configuration may be used as a cap to cover the junction between two abutting co-linear mouldings partway along a wall. The linear mouldings may also comprise the side and front panels of a box-like valance structure, with the corner assemblies installed at the corners where the front and side panels meet. There are of course numerous other moulding and trim installations for which the present invention may be readily adapted, such as where the respective elements might be installed in association with a built-in shelf unit, or around a window or door frame, or in an application where it is desired to provide a decorative capping or termination of the free end of one or more linear mouldings.

FIGS. 1 and 2 show linear mouldings 2, which in this case consist of crown or cornice moulding members positioned for installation at an inside corner of a room. A corner assembly 4 consists of first and second mating, mirror-image corner components 4(*a*) and (*b*). These components are each slidingly engaged over the exposed outer surface of the respective linear mouldings and when installed are positioned generally so as to overlap the exposed ends 5 of these mouldings. The overlap provides a stepped appearance where the corner assembly meets the linear moulding. The exposed end faces of the corner assembly are generally squared-off to present the appearance of a mitred corner cap that abuts the end or the linear moulding. As seen in FIG. 3, the linear mouldings in this case each consist of an extrusion having a hollow profile. A decorative slat or strip 6 is installed within a channel of the moulding, as shown more particularly in FIG. 3. The cross-sectional profile of the corner components 4 generally matches the exposed outer surface of the linear moulding, in order to present a unified appearance at the intersection between the corner and the linear elements. The matching of the respective surfaces permits the underside face of the corner component to conform to the outer face of the linear moulding.

When seen in section, the corner assembly consists of upper and lower rim portions 7(*a*) and (*b*), respectively, with a rigid web 8 extending therebetween. The rims are each characterized by a ribbed outside face and an elongate hook-shaped flange 14 on the inside face of each rim. The flange 14, which extends the length of the rim, comprises a snap-locking releasable engagement member adapted to mate with a corresponding rib 15 extending from the linear moulding. The rib 15 fits within the channel 16 defined by the hook-like flange to form a snap-lock engagement that permits the respective members to be linearly displaced relative to each other.

As seen in FIGS. 1 and 2, the two components 4(*a*) and (b) are when seen in plan view each generally in the shape of a truncated triangle that form mirror images of each other. The components when brought together at the midline of a corner mate to form a generally L-shaped corner assembly. The shape of the components permits them to form an assembly that angles upwardly and outwardly to conform to the corner of a cornice moulding. The abutting end faces of the components are angled and bevelled to form a flush joint when the respective components are brought together.

It will be seen that a corner assembly may be adapted for use in installations where the linear moulding terminates at a corner or the like and does not extend around the corner. The corner assembly for this application consists of a single generally planar element having a generally rectangular shape in plan view, adapted to be engaged to a single linear member. A similar assembly may be used where it is desired to cap the free end of a linear moulding partway along a wall, such as where adjacent linear mouldings abut.

It will be further seen that a corner assembly may have a cross-sectional profile to match essentially any linear moulding. Since the profile of the corner assembly must match that of the linear moulding with a fair degree of precision, it is necessary to provide a corner assembly adapted for use with a specific type of linear moulding. Preferably, the particular linear moulding provided in association with the corner assembly will be provided with sliding engagement means that mate with corresponding means on the corner assembly.

Installation of an L-shaped corner assembly is effected by initially sliding a pair of mating corner components onto abutting linear mouldings. If the linear mouldings have already been installed, the corner assembly may be snap-fitted into place. Once the linear mouldings have been screwed or nailed into position, the corner components are brought together at the corner by simply sliding them into position along the linear moulding to achieve a corner assembly having the appearance of a flush-fitting, mitered corner, as seen in FIG. 1.

In a second embodiment, the cap comprises a generally planar, platelike member and consists of but one of the components 4(*a*) or 4(*b*). One or both end faces of the cap may be squared-off. A cap of this configuration may be used to join two adjacent and co-linear mouldings, for example for use in a chair-rail type moulding, or where a baseplate or other moulding terminates at a corner and it is desired to provide a decorative cap to provide a finished appearance to the exposed end of the moulding.

It will be seen by those skilled in the art to which this invention pertains that although the present invention has been defined by way of particular embodiments thereof, numerous variants of and departures therefrom may be made without departing from the spirit and scope of the invention, as defined in the appended claims.

We claim:

1. A moulding assembly comprising a linear moulding and a corner cap separable from said linear moulding and covering an exposed end of said linear moulding, said corner cap comprising upper and lower rims and a web portion extending therebetween, said rims each being characterized by engagement means releasably engaging said linear moulding in a snap-lock sliding engagement, said engagement means comprising an elongate flange having a generally hook-shaped cross section mating with a rib extending from said linear moulding to permit said cap to be displaced linearly relative to said linear moulding following installation of said linear moulding to a wall member.

2. The assembly as in claim 1 comprising two of said linear mouldings for attachment to corresponding abutting walls, said abutting walls meeting at a corner, and wherein said cap is shaped to fit around said corner, said cap comprising two separable limbs, each of said two limbs engaged to one of said linear mouldings and slid into position along said one of said linear mouldings, said limbs adapted to meet at said corner to form a generally L-shaped member.

3. The assembly as in claim 1 comprising a crown moulding.

4. The assembly as in claim 1, the moulding comprising a valance comprised of elongate valance panels in a box-like arrangement wherein said valance panels angle inwardly and downwardly.

5. The assembly as in claim 1, wherein said linear moulding element incorporates exposed upper and lower edge regions each having a ribbed exterior face, said upper and lower rims of said cap each being characterized by a ribbed exterior face which corresponds generally with said ribbed exterior face of said upper and lower edge regions of said linear moulding.

6. A moulding assembly comprising a linear moulding and a cap, said linear moulding characterized by a front face comprising a removable decorative panel releasably retained within a channel recessed into said linear moulding; said cap converting an exposed end of said linear moulding, said cap comprising upper and lower rims and a web portion extending therebetween, said rims each being characterized by engagement means releasably engaging said linear moulding in a snap-lock sliding engagement and comprising an elongate flange having a generally hook-shaped cross section mating with a rib extending from said linear moulding to permit said cap to be displaced linearly relative to said linear moulding following installation of said linear moulding to a wall member.

7. The assembly as in claim 6, wherein said web portion is shaped to maintain a spaced-apart relation with said decorative panel sufficient to permit said decorative panel to be slideably received between said web and said moulding.

8. The assembly as in claim 6 comprising two linear mouldings for attachment to two corresponding abutting walls, said walls meeting at a corner, and wherein said cap is shaped to fit around said corner, said cap comprising two separable limbs, each of said two limbs being engaged to one of said linear mouldings and slid into position along said one of said linear moulding, said limbs adapted to meet at said corner to form a generally L-shaped member.

9. The assembly as in claim 6 comprising a crown moulding assembly.

10. The assembly as in claim 6 comprising a valance assembly comprised of valance panels wherein said linear moulding comprises side and front valance panels arranged in a box-like configuration wherein said valance panels angle inwardly and downwardly.

11. The assembly as in claim 6, wherein said linear moulding incorporates upper and lower edge regions, each of said edge regions having a ribbed exterior face; said upper and lower rims of said cap each being characterized by a ribbed exterior face which corresponds generally with said ribbed exterior face of said upper and lower edge regions of said linear moulding.

* * * * *